US008065751B2

(12) United States Patent
Chen

(10) Patent No.: US 8,065,751 B2
(45) Date of Patent: Nov. 29, 2011

(54) MOISTURE-ABSORBABLE HAT

(76) Inventor: Chung-Sen Chen, Taichung County (TW)

( * ) Notice: Subject to any disclaimer, the term of this patent is extended or adjusted under 35 U.S.C. 154(b) by 550 days.

(21) Appl. No.: 12/345,456

(22) Filed: Dec. 29, 2008

(65) Prior Publication Data

US 2010/0162465 A1 Jul. 1, 2010

(51) Int. Cl.
*A42C 5/00* (2006.01)

(52) U.S. Cl. ..... 2/181; 2/182.3; 2/183; 2/181.6; 2/181.2; 57/205; 57/208

(58) Field of Classification Search ..... 2/181, 182.3, 2/183, 181.6, 181.2; 57/205, 208, 226, 33
See application file for complete search history.

(56) References Cited

U.S. PATENT DOCUMENTS

| | | | | |
|---|---|---|---|---|
| 4,869,951 | A * | 9/1989 | McCullough et al. | 442/189 |
| 5,566,395 | A * | 10/1996 | Nebeker | 2/181 |
| 2006/0218688 | A1 * | 10/2006 | Cheng | 2/12 |
| 2007/0077223 | A1 * | 4/2007 | Tai | 424/76.2 |
| 2008/0139069 | A1 * | 6/2008 | Chang et al. | 442/362 |

* cited by examiner

*Primary Examiner* — Khoa Huynh
*Assistant Examiner* — Alissa Tompkins
(74) *Attorney, Agent, or Firm* — Chun-Ming Shih

(57) ABSTRACT

A moisture-absorbable hat includes: a crown made of a woven fabric including warp and weft textured charcoal fiber yarns, warp and weft non-charcoal fiber yarns which are not elastic and are not textured, and weft elastofiber yarns, the elastofiber yarns extending along a circumferential direction of the crown; and a sweatband attached to and extending along a circumferential open end of the crown and including warp and weft textured charcoal fiber yarns, and weft elastofiber yarns.

5 Claims, 4 Drawing Sheets

MOISTURE-ABSORBABLE HAT

BACKGROUND OF THE INVENTION

1. Field of the Invention

The invention relates to a hat, more particularly to a moisture-absorbable hat.

2. Description of the Related Art

As shown in FIG. 1, a conventional hat includes a crown 1, a visor 2 projecting from a circumferential bottom end of the crown 1, and a sweatband 3 attached to and extending along the circumferential bottom end of the crown 1. Generally, the crown 1 and/or the sweatband 3 are made from leather, a plastic material, or a woven fabric (for example, a fabric including elastofiber yarns and cotton yarns). The sweatband 3 can be stretched to fit various head sizes of hat wearers. Furthermore, the crown 1 and the sweatband 3 that are made from the woven fabric can absorb the sweat of a wearer.

However, the humidity inside the hat would still undesirably increase with time, thereby resulting in user discomfort.

SUMMARY OF THE INVENTION

Therefore, an object of the present invention is to provide a moisture-absorbable hat that can absorb perspiration and moisture efficiently and that can overcome the aforesaid drawback associated with the prior art.

Accordingly, a moisture-absorbable hat of the present invention comprises: a crown having a circumferential open end and made of a woven fabric including warp and weft textured charcoal fiber yarns, warp and weft non-charcoal fiber yarns which are not elastic and are not textured, and weft elastofiber yarns, the elastofiber yarns extending along a circumferential direction of the crown; and a sweatband attached to and extending along the circumferential open end and including warp and weft textured charcoal fiber yarns, and weft elastofiber yarns.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
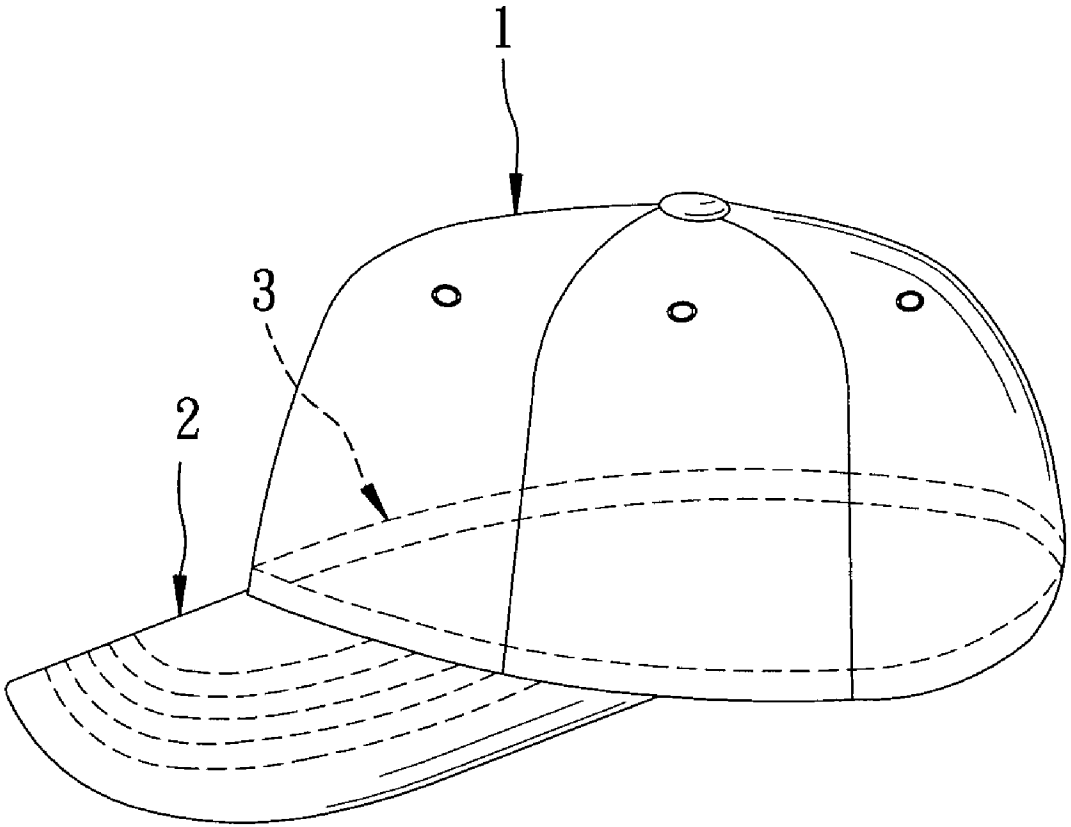
FIG. 1 PRIOR ART
FIG. 1 is a perspective view of a conventional hat.
Figure 2:
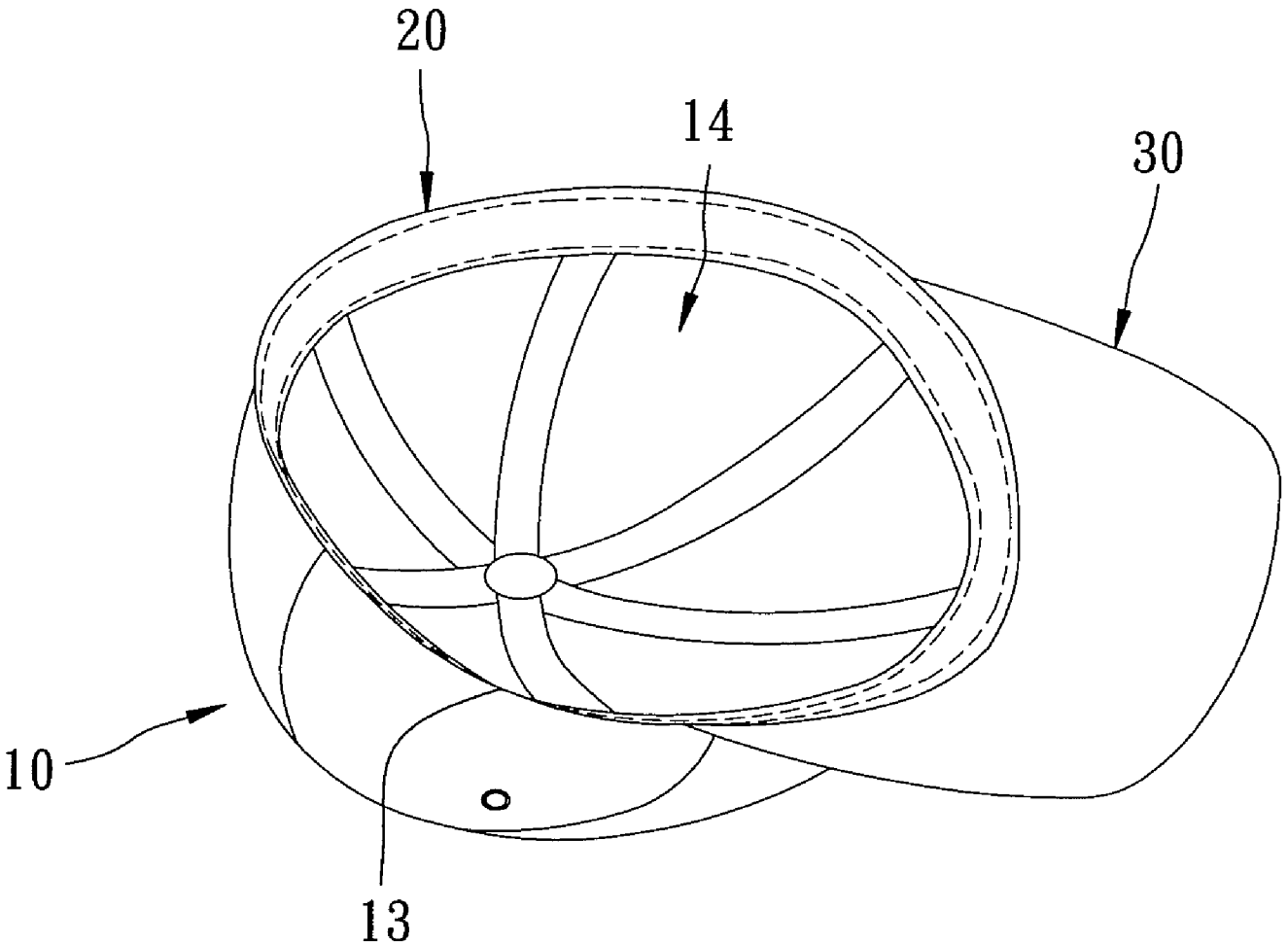
FIG. 2 is a perspective view of the preferred embodiment of a moisture-absorbable hat according to the present invention.

Referring to FIG. 2, the preferred embodiment of a moisture-absorbable hat according to the present invention is shown to include a crown 10, a sweatband 20, and a visor 30.

The crown 10 provides a receiving space 14 for receiving the head of a wearer, and has a circumferential open end 13 for access to the receiving space 14. The sweatband 20 is attached to and extends along the circumferential open end 13. The visor 30 projects from the circumferential open end 13 of the crown 10.

Figure 3:
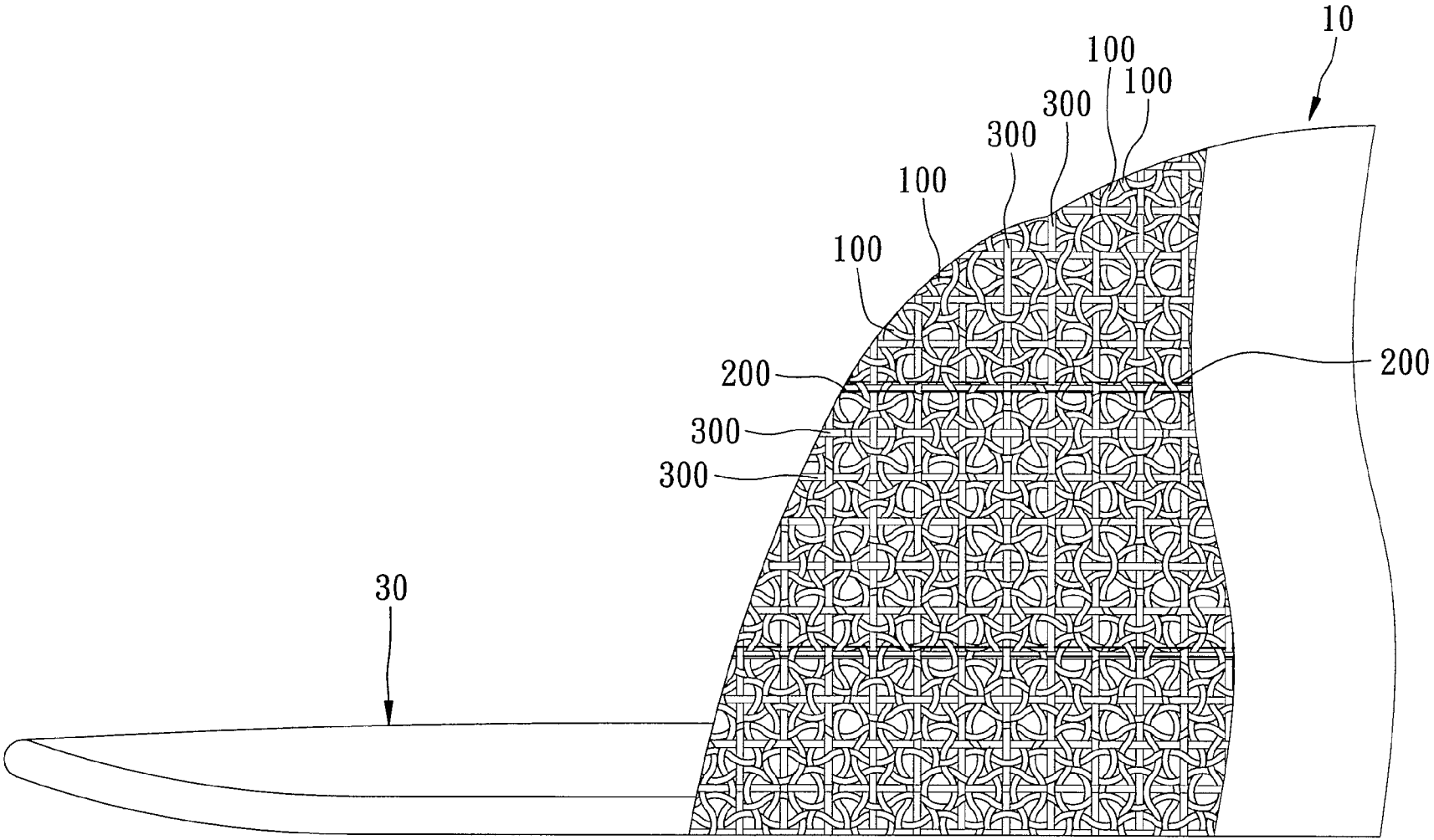
FIG. 3 is a fragmentary schematic view to illustrate the arrangement of yarns of a crown of the preferred embodiment.

As shown in FIG. 3, the crown 10 is made of a woven fabric including: warp and weft textured charcoal fiber yarns 100, warp and weft non-charcoal fiber yarns 300 which are not elastic and are not textured, and weft elastofiber yarns 200. Preferably, the textured charcoal fiber yarns 100 occupy 45%-55% of a total surface area of the crown 10, the elastofiber yarns 200 occupy 1%-3% of the total surface area of the crown 10, and the non-charcoal fiber yarns 300 occupy 42%-54% of the total surface area of the crown 10. More preferably, the textured charcoal fiber yarns 100 occupy 50% of a total surface area of the crown 10, the elastofiber yarns 200 occupy 2% of the total surface area of the crown 10, and the non-charcoal fiber yarns 300 occupy 48% of the total surface area of the crown 10.

In the preferred embodiment, each of the warp or weft non-charcoal fiber yarns 300 in the crown 10 is provided at every third position in the crown 10 and between two pairs of the warp or weft textured charcoal fiber yarns 100. The elastofiber yarns 200 extend only along a circumferential direction of the crown 10. Moreover, the non-charcoal fiber yarns 300 may be cotton yarns or man-made or synthetic fiber yarns.

Figure 4:
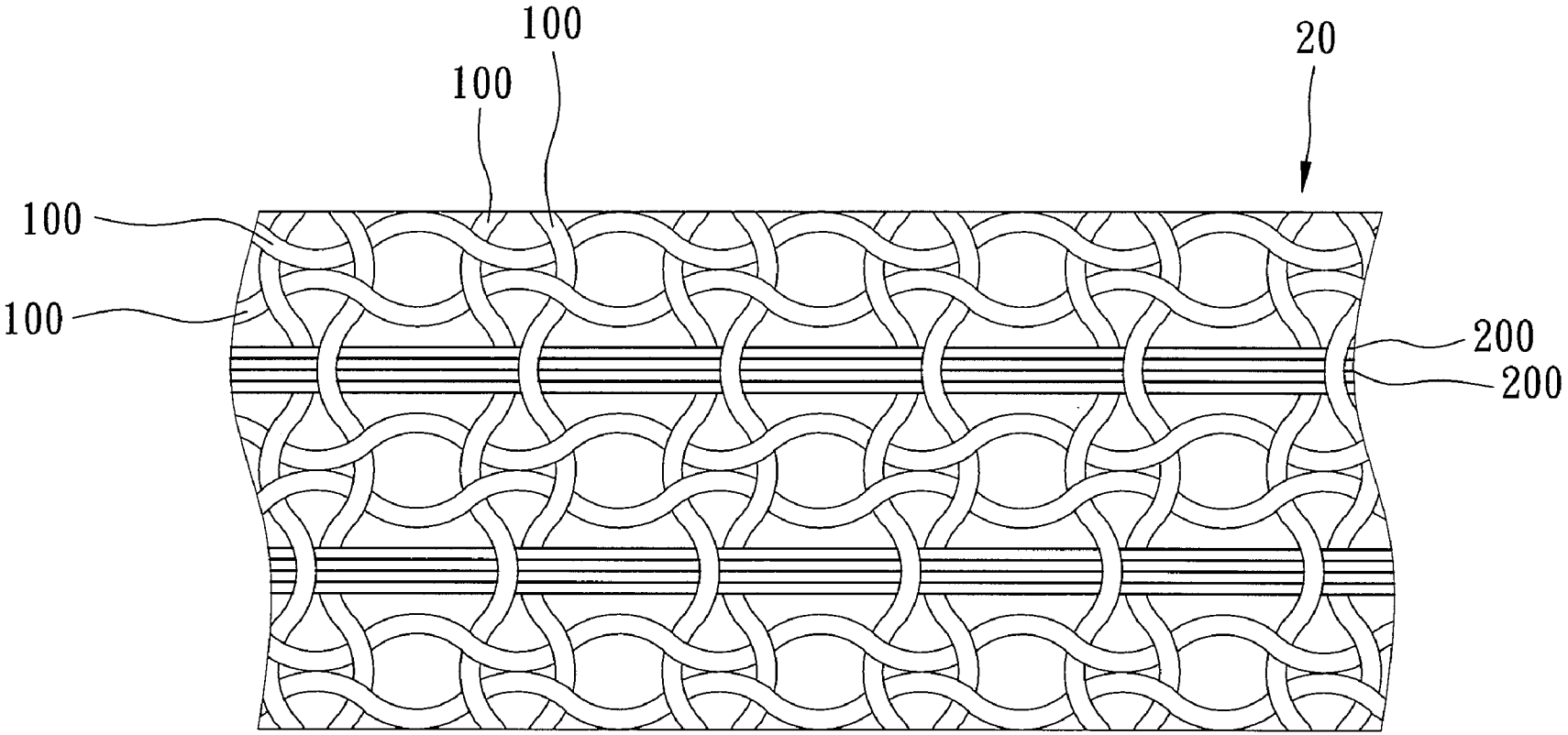
FIG. 4 is a fragmentary schematic view to illustrate the arrangement of yarns of a sweatband of the preferred embodiment.

As shown in FIG. 4, the sweatband 20 includes warp and weft textured charcoal fiber yarns 100, and weft elastofiber yarns 200. Preferably, the textured charcoal fiber yarns 100 occupy 70%-80% of a total surface area of the sweatband 20, and the elastofiber yarns 200 occupy 20%-30% of the total surface area of the sweatband 20. More preferably, the textured charcoal fiber yarns 100 occupy 75% of a total surface area of the sweatband 20, and the elastofiber yarns 200 occupy 25% of the total surface area of the sweatband 20.

It is noted that, every four weft elastofiber yarns 200 are juxtaposed as one group in the sweatband 20. Each group of the four juxtaposed weft elastofiber yarns 200 is provided between two pairs of the weft textured charcoal fiber yarns 100.

In the preferred embodiment, the charcoal fiber yarns 100 used in the crown 10 and the sweatband 20 are hollow charcoal fibers which may be produced from bamboo charcoal in a conventional manner.

With the aforesaid fiber yarn orientation of the moisture-absorbable hat which makes use of a relatively high amount of charcoal fibers 100, the breathability of the moisture-absorbable hat according to the present invention can effectively absorb perspiration and moisture, and the aforesaid drawback associated with the prior art can be alleviated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A moisture-absorbable hat comprising:

a crown having a circumferential open end, and made of a woven fabric including warp and weft textured charcoal fiber yarns, warp and weft non-charcoal fiber yarns which are not elastic and are not textured, and weft elastofiber yarns, said elastofiber yarns extending along a circumferential direction of said crown; and a sweatband attached to and extending along said circumferential open end and including warp and weft textured charcoal fiber yarns, and weft elastofiber yarns wherein said textured charcoal fiber yarns are made from charcoal hollow fibers.

2. The moisture-absorbable hat of claim 1, wherein each of said warp or weft non-charcoal charcoal fiber yarns is provided at every third position in said crown and between two pairs of said textured charcoal fiber yarns.

3. The moisture-absorbable hat of claim 1, wherein said textured charcoal fiber yarns occupy 45%-55% of a total surface area of said crown, said elastofiber yarns occupy 1%-3% of the total surface area of said crown, and said non-charcoal fiber yarns occupy 42%-54% of the total surface area of said crown.

4. The moisture-absorbable hat of claim 1, wherein said textured charcoal fiber yarns occupy 70%-80% of a total surface area of said sweatband, and said elastofiber yarns occupy 20%-30% of the total surface area of said sweatband.

5. The moisture-absorbable hat of claim 1, wherein every four weft elastofiber yarns are juxtaposed as one group in said sweatband, and each group of said four juxtaposed weft elastofiber yarns is provided between two pairs of said weft textured charcoal fiber yarns.

* * * * *